United States Patent [19]

Acton

[11] Patent Number: 4,789,138

[45] Date of Patent: Dec. 6, 1988

[54] FENCE GUARD DEVICE

[76] Inventor: Mary Acton, 2432 St. Rt. 753, SE., Washington Court House, Ohio 43160

[21] Appl. No.: 121,868

[22] Filed: Nov. 17, 1987

[51] Int. Cl.[4] ..... E04H 17/14

[52] U.S. Cl. ..... 256/59; 256/1; 52/716

[58] Field of Search ..... 252/59, 66, 1; 52/716, 52/717, 718, 823, 824, 825

[56] References Cited

U.S. PATENT DOCUMENTS 2,564,386 8/1951 Webb ..... 52/823 X 3,193,255 7/1965 Burdett ..... 256/59 X 3,416,282 12/1968 Daugherty ..... 52/823 X 3,934,385 1/1976 Paulus ..... 52/716 X

*Primary Examiner*—Andrew V. Kundrat

*Attorney, Agent, or Firm*—Richard C. Litman

[57] ABSTRACT

A fence protecting device having a top element with two support elements depending vertically downwardly therefrom, the device formed of single sheet construction so that as the support elements are bent downward to enfold over an upper surface of a fence top rail. Fastening means integral with the support elements engage the side of the top rail member and hold the device thereto.

5 Claims, 2 Drawing Sheets

3
3

FENCE GUARD DEVICE

FIELD OF INVENTION

Fence maintenance, due to damage by the elements or wear and tear caused by animals, is a major expense of ranch or farm operations. Horses, for example, rub up against and occasionally bite and chew on the wood top rail of fences. This invention relates to a means for protecting fences and, more particularly to a means for protecting the top rail of such fencing to prevent horses or other livestock from damaging and chewing upon them.

BACKGROUND OF THE INVENTION

Most ranch fencing is of wood construction. Paddocks and other areas where horses are contained are usually of wood because it has attractive qualities and will not usually injure a horse or other animal running close to them. The disadvantage to wood as opposed to steel construction, especially barbed wire, is that wood is expensive and, although it looks attractive, it requires more upkeep in waterproofing, renailing, straightening and painting than do many other types of fencing.

The present invention provides a means for protecting the top rail of a wood fence. The horizontal uppermost or top rail is typically the fence member to be subjected to the chewing of horses and to the rubbing action of their necks against it. By providing an overlying device, the upper surface of the top rail is protected against the effects of rain and against the action of livestock interacting with it.

This invention requires no nails or other exterior fasteners to secure the device to the fence top rail, but instead relies upon elements integral to and provided within the invention itself to simplify the installation of the device and to insure most positive retention.

The same integral fastening means allows the device to be easily intentionally removed from fencing by humans and reapplied to other fencing without any unnecessary expense. This re-use is made possible by the positioning of the fastening means adjacent to the bottom edge of the device so as to present easy access with simple hand tools to effect the removal of the fence protector and the re-installation.

SUMMARY OF THE PRIOR ART

The following cited references are found to be exemplary of the U.S. prior art.

| U.S. Pat. No. | Inventor |
|---|---|
| 4,516,756 | Beatty |
| 4,181,764 | Totten |
| 3,910,561 | Fornells |

U.S. Pat. No. 4,516,756, issued to Beatty, discloses a plastic sheath for fencing. It takes the form of a synthetic plastic fence sheath element that would be placed over an unfinished post.

U.S. Pat. No. 4,181,764, to Totten, teaches the construction of a rail comprising an elongated wood member and a weather and abrasion resistant protective coating surrounding the core and is utilized to reduce the problems associated with weather, moisture and animals chewing the fences.

U.S. Pat. No. 3,910,561, issued to Fornells discloses a hollow pole device made of plastic material to form a fence that is relatively easy to assemble and disassemble.

Other references are U.S. Pat. Nos. 2,545,845, 2,802,644, 3,472,489 that disclose various protective coverings for fences and also plastic fences to prevent animal chewing and weather damage to them.

None of the prior art, however, whether taken singularly or in combination disclose the specific features of the present invention in any way so as to bear upon the claims as appended hereto.

BRIEF SUMMARY OF THE INVENTION

An object and advantage of the invention is to provide a fence protector with integral fastening means so as to permit the rapid and economical installation of the device and the reinstallation of it as may be necessary.

Another object is to provide a fence protector device having grip elements disposed in opposition as the device is installed on a wooden top rail of a fence for the advantageous seating and positive fitting of the device to the upper reaches of a top rail. The device is conformable to the configuration of the wood and achieves a close tolerance fit to the upper reaches of the top rail by virtue of the fastening elements deployed opposingly, in pairs, on the device.

Another object is to provide a fence protector that includes opposite ends having truncated terminal edges to eliminate sharp corners and edges from the device as it is deployed on the top rail.

The invention has a further object of being adaptable to a wide variety of widths of top rails and other fencing in that it is of one-piece construction having bent downwardly portions, forming a pair of support elements depending from a top element and wherein the width of the top element that lies upon the top of the top rail is dependent on the width of the wood. The device therefore is adaptable to fit lengthwise along top rails of many different widths of wood.

DESCRIPTION OF THE PREFERRED EMBODIMENT

Figure 1:
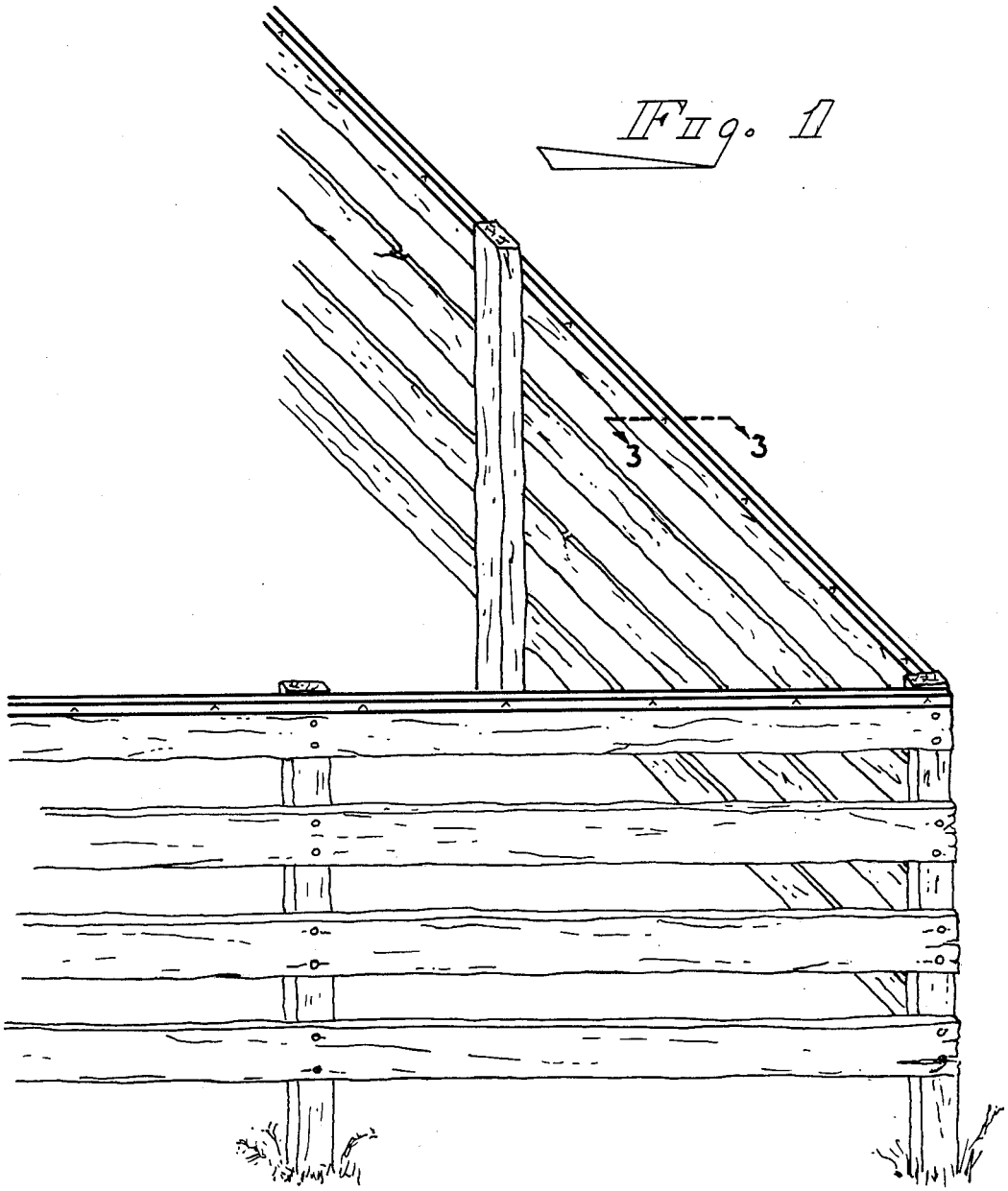
FIG. 1 is a perspective view of the device.

Referring now to the drawing, in which like numerals refer to like elements throughout, the fence guard 10 is constructed of any suitable material such as sheet metal or plastic and includes a top element 12 that is deployed lengthwise along the top rail of a fence.

Support elements 14 and 14' depend downwardly from the top element 12, forming substantially right angles with top element 12 and each such support element is adapted to be disposed in contact with, or urged against the sides 13 of the top rail 15. A plurality of fastening means, such as fastening elements 16 are integral to support elements 14 and 14'.

Fastening means 16 include fastening elements 17 having a lowermost side 17' in common with its respective support element and joined to two sides 18 and 20 inclined inwardly and forming an upwardly directed apex 22. The apices 22 are all disposed toward the top element 12 so that as the device 10 is installed downwardly upon a top rail 15, top element 12 is folded, the support element 14, 14' closely engage the top rail sides 13 and, the fastening elements 17 being biased, firmly engage these sides 13, with the apices 22 biting into the fibers of the wood of the top rail 15.

Figure 2:
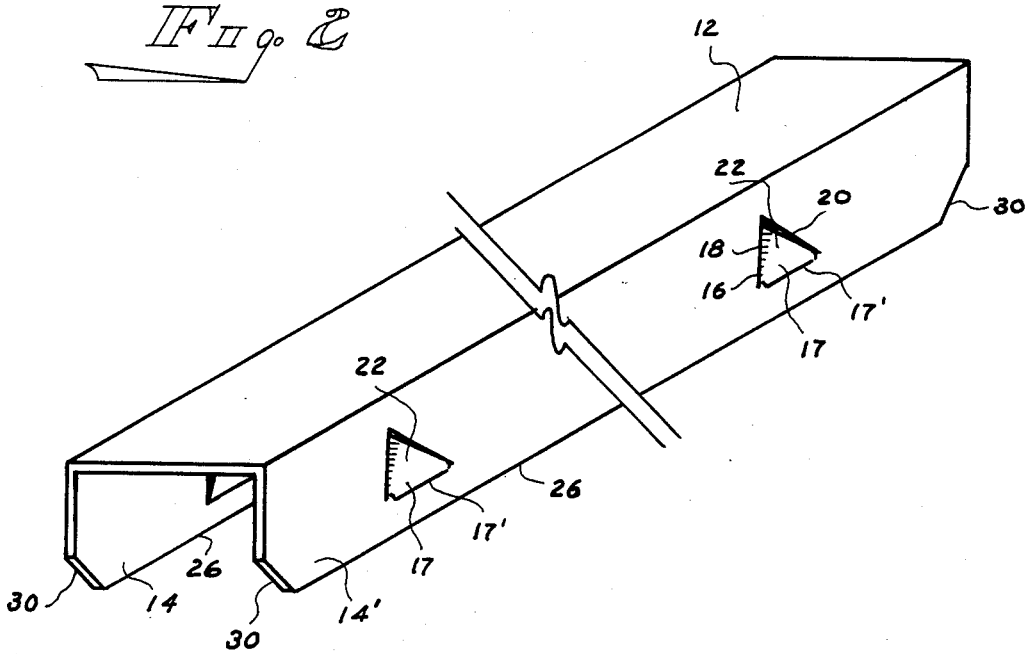
FIG. 2 is a detail perspective view illustrating the integral fastening means that are deployed substantially in a longitudinal axis along the lower reaches of a pair of support elements.
Figure 3:
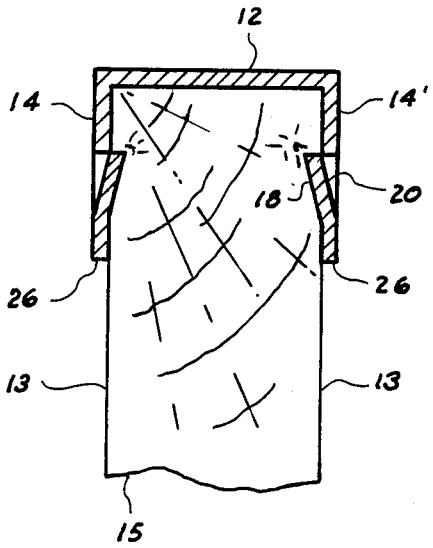
FIG. 3 is a side view of one of the support elements and indicates the inward positioning of the fastening elements as they press into the fibers of the side of the top rail.

As support elements 14 and 14' are biased to the wood, the apex 22 of fastening elements 17 function to wedge the fastening elements 17 deeper into the fibers of the wood as shown in FIG. 2 as any action to remove on the device is resisted by this action. Fastening elements 17 will be seen to be along a longitudinal axis slightly offset from the lowermost edge 26 of support members 14 and 14' as shown in FIG. 3.

Intentional removal of the device 10 is accomplished by prying outwardly with a handtool to separate the elements 17 from the rail sides 13.

The rail guard 10 is segmented into appropriate lengths that correspond with the length of the top rail 15 over which it is to be fitted. Each terminal end of the rail guard 10 is provided a truncated lower corner 30 to eliminate sharp corners and edges that may snap clothing of an individual leaning against the fence or injure livestock brushing against it.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents, which may be resorted to, fall within the scope of the invention.

What is claimed is:

1. A series of separate segments to protect rails of a fence including an individual segmented protector comprising;

a top element having a pair of support elements depending downwardly therefrom; said support elements each forming substantially right angles with said top element;

a plurality of fastening elements carried by each said support element, and integral therewith, said fastening elements disposed substantially along a longitudinal axis of said support elements, said fastening elements engageable with a fence top rail whereby said protector is retained on top rail of the fence;

each of said fastening elements include an integral grip element, said grip elements disposed inwardly from said support elements to urge or bias against the fence top rail whereby said grip elements secure said protector to said fence top rail and presents resistance to the removal therefrom;

said grip elements have a lowermost side in common with said support elements and have sides forming an apex opposed to said common side; said apex disposed inwardly and toward said top element, said fastening elements are deployed substantially in opposition on said support element and proximate to a lower longitudinal edge of said support elements and said support elements include opposite ends having truncated terminal corners thereon, whereby sharp corners are removed from the terminal edges during deployment and to avoid injury to livestock.

2. A fence protector as recited in claim 1 wherein said support elements have a width dependent on a width of said top element whereby said device may be installed on a fence top rail of varying thickness of wood.

3. A fence protector as recited in claim 1 wherein said protector is of single sheet construction, said support elements being folded downwardly from said top element to form an overlay structure for a top rail.

4. A fence protector as recited in claim 1 wherein said pair of support elements are opposingly deployed on the fence top rail.

5. A fence protector as recited in claim 1 wherein the protector is constructed of thin metal material whereby the protector conforms to the irregularities along said of fence top rail, bending through the irregularities thereof.

* * * * *